US007206424B2

(12) United States Patent
Sacha

(10) Patent No.: US 7,206,424 B2
(45) **Date of Patent: *Apr. 17, 2007**

(54) HEARING AID WITH TIME-VARYING PERFORMANCE

(75) Inventor: Mike K. Sacha, Chanhassen, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/997,805

(22) Filed: Nov. 24, 2004

(65) Prior Publication Data

US 2005/0254675 A1 Nov. 17, 2005

Related U.S. Application Data

(63) Continuation of application No. 10/146,986, filed on May 16, 2002, now Pat. No. 6,829,363.

(51) Int. Cl.
*H04R 25/00* (2006.01)

(52) U.S. Cl. ..... 381/315; 381/60

(58) Field of Classification Search ..... 381/312, 381/314, 316, 23.1, 315, 317, 318, 320, 321, 381/60, 323; 600/559; 702/57
See application file for complete search history.

(56) References Cited

U.S. PATENT DOCUMENTS 3,527,901 A 9/1970 Geib
4,366,349 A 12/1982 Adelman
4,396,806 A 8/1983 Anderson
4,419,544 A 12/1983 Adelman
4,471,490 A 9/1984 Bellafiore
4,637,402 A 1/1987 Adelman
4,882,762 A 11/1989 Waldhauer
5,390,254 A 2/1995 Adelman
5,434,924 A 7/1995 Jampolsky
5,502,769 A 3/1996 Gilbertson
5,553,152 A 9/1996 Newton
5,581,747 A 12/1996 Anderson
5,659,621 A 8/1997 Newton (Continued)

FOREIGN PATENT DOCUMENTS

DE 19542961 5/1997

(Continued)

OTHER PUBLICATIONS

Griffing, Terry S., et al., "Acoustical Efficiency of Canal ITE Aids", *Audecibel*, (Spring 1983),30-31.

(Continued)

*Primary Examiner*—Sinh Tran
*Assistant Examiner*—Brian Ensey
(74) *Attorney, Agent, or Firm*—Schwegman, Lundberg, Woessner & Kluth, P.A.

(57) ABSTRACT

A hearing aid that compensates for a patient's hearing deficit in a gradually progressing fashion. The hearing aid may be programmed to successively select in a defined sequence a parameter set that defines at least one operating characteristic of the signal processing circuit from a group of such parameter sets. The defined sequence may end in a parameter set that optimally compensates the patient's hearing.

25 Claims, 2 Drawing Sheets

U.S. PATENT DOCUMENTS

| | | | | |
|---|---|---|---|---|
| 5,717,770 | A | 2/1998 | Weinfurtner | |
| 5,757,933 | A | 5/1998 | Preves et al. | |
| 5,822,442 | A | 10/1998 | Agnew et al. | |
| 5,835,611 | A | 11/1998 | Kaiser et al. | |
| 5,852,668 | A | 12/1998 | Ishige et al. | |
| 5,862,238 | A | 1/1999 | Agnew et al. | |
| 6,041,129 | A | 3/2000 | Adelman | |
| 6,236,731 | B1 | 5/2001 | Brennan et al. | |
| 6,240,192 | B1 | 5/2001 | Brennan et al. | |
| 6,347,148 | B1 | 2/2002 | Brennan et al. | |
| 6,366,863 | B1 | 4/2002 | Bye et al. | |
| 6,389,142 | B1 | 5/2002 | Hagen et al. | |
| 6,449,662 | B1 | 9/2002 | Armitage | |
| 6,741,712 | B2 * | 5/2004 | Bisgaard | 381/312 |
| 2001/0007050 | A1 | 7/2001 | Adelman | |
| 2001/0055404 | A1 | 12/2001 | Bisgaard | |
| 2002/0071582 | A1 * | 6/2002 | Troelsen et al. | 381/314 |
| 2002/0076073 | A1 | 6/2002 | Taenzer et al. | |
| 2003/0215105 | A1 | 11/2003 | Sacha | |

FOREIGN PATENT DOCUMENTS

| | | |
|---|---|---|
| DE | 10021985 | 10/2001 |
| EP | 0964603 A1 | 12/1999 |
| WO | WO-00/21332 | 4/2000 |

OTHER PUBLICATIONS

Griffing, Terry S., et al., "Custom canal and mini in-the-ear hearing aids", *Hearing Instruments*, vol. 34, No. 2, (Feb. 1983),31-32.

Griffing, Terry S., et al., "How to evaluate, sell, fit and modify canal aids", *Hearing Instruments*, vol. 35, No. 2, (Feb. 1984),3.

Mahon, William J., "Hearing Aids Get a Presidential Endorsement", *The Hearing Journal*., (Oct. 1983),7-8.

Sullivan, Roy F., "Custom canal and concha hearing instruments: A real ear comparison", *Hearing Instruments*, 40(4), (Jul. 1989),5.

Sullivan, Roy F., "Custom canal and concha hearing instruments: A real ear comparison Part II", *Hearing Instruments*, vol. 40, No. 7, (Jul. 1989),6.

* cited by examiner

HEARING AID WITH TIME-VARYING PERFORMANCE

CROSS-REFERENCE TO RELATED APPLICATIONS(S)

This application is a continuation of U.S. patent application Ser. No. 10/146,986, filed on May 16, 2002, now U.S. Pat. No. 6,829,363, the specification of which is incorporated herein by reference.

FIELD OF THE INVENTION

This invention pertains to devices and methods for treating hearing disorders and, in particular, to electronic hearing aids.

BACKGROUND

Hearing aids are electronic instruments worn in or around the ear that compensate for hearing losses by amplifying sound. Because hearing loss in most patients occurs non-uniformly over the audio frequency range, most commonly in the high frequency range, hearing aids are usually designed to compensate for the hearing deficit by amplifying received sound in a frequency-specific manner. Adjusting a hearing aid's frequency specific amplification characteristics to achieve a desired optimal target response for an individual patient is referred to as fitting the hearing aid. The optimal target response of the hearing aid is determined by testing the patient with a series of audio tones at different frequencies. The volume of each tone is then adjusted to a threshold level at which it is barely perceived by the patient. The hearing deficit at each tested frequency can be quantified in terms of the gain required to bring the patients hearing threshold to a normal value. For example, if the normal hearing threshold for a particular frequency is 40 dB, and the patient's hearing threshold is 47 dB, 7 dB of amplification gain by the hearing aid at that frequency results in optimal compensation.

Most often, a new hearing aid user is not fitted with the optimal target response at the first audiologist visit. This is because a patient with a hearing deficit that is suddenly compensated at an optimal level may find the new sounds uncomfortable or even intolerable until adaptation occurs. Patients initially fitted with optimal compensation may even discontinue using their hearing aid. Therefore, it is common practice for the audiologist to initially fit the hearing aid with a sub-optimal degree of compensation which is then ramped up to the optimal level during subsequent fittings at a rate the patient finds comfortable.

SUMMARY

Adjusting a hearing aid with repeated fittings performed by an audiologist, however, may be inconvenient and also adds to the expense of the device for the patient. In accordance with the present invention, a hearing aid is equipped with a signal processing circuit for filtering and amplifying an input signal in accordance with a set of specified signal processing parameters that dictate the filtering and amplification characteristics of the device. The parameter set may also define other operating characteristics such as the degree of compression or noise reduction. The hearing aid is then programmed to automatically sequence through different parameter sets so that its compensation gradually adjusts from a sub-optimal to an optimal level. The device may be programmed to select a signal processing parameter set for specifying to the signal processing circuit from a group of such parameter sets in a defined sequence based upon elapsed operating time intervals as measured by a timer or upon a specified number of detected power events representing the device being turned on.

DETAILED DESCRIPTION

Figure 1:
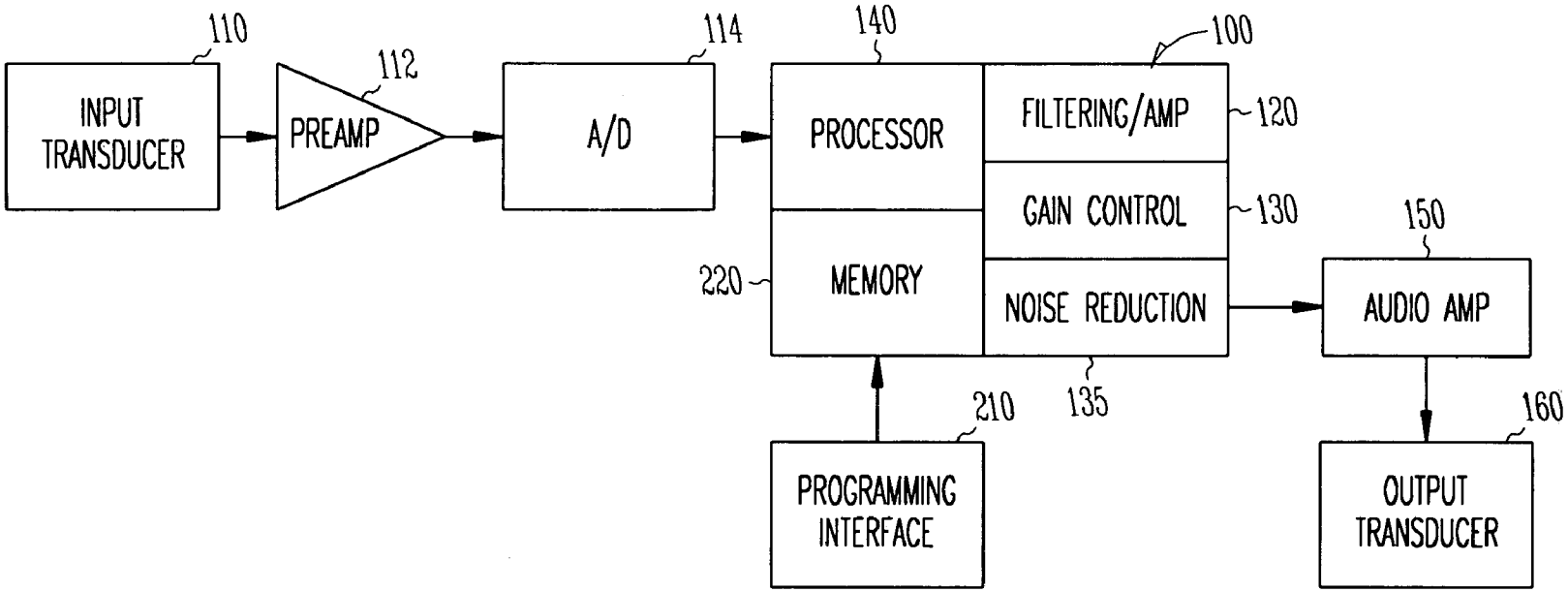
FIG. 1 is a block diagram of the components of an exemplary hearing aid.

A hearing aid is a wearable electronic device for correcting hearing loss by amplifying sound. The electronic circuitry of the device is contained within a housing that is commonly either placed in the external ear canal or behind the ear. Transducers for converting sound to an electrical signal and vice-versa may be integrated into the housing or external to it. The basic components of an exemplary hearing aid are shown in FIG. 1. A microphone or other input transducer 110 receives sound waves from the environment and converts the sound into an input signal IS. After amplification by pre-amplifier 112, the signal IS is sampled and digitized by A/D converter 114. Other embodiments may incorporate an input transducer that produces a digital output directly. The device's signal processing circuitry 100 processes the digitized input signal IS into an output signal OS in a manner that compensates for the patient's hearing deficit. The output signal OS is then passed to an audio amplifier 150 that drives an output transducer 160 for converting the output signal into an audio output, such as a speaker within an earphone.

In the embodiment illustrated in FIG. 1, the signal processing circuitry 100 includes a programmable controller made up of a processor 140 and associated memory 220 for storing executable code and data. The overall operation of the device is determined by the programming of the controller, which programming may be modified via a programming interface 210. The programming interface 210 allows user input of data to a parameter modifying area of the memory 220 so that parameters affecting device operation may be changed. The programming interface 210 may allow communication with a variety of devices for configuring the hearing aid such as industry standard programmers, wireless devices, or belt-worn appliances.

The signal processing modules 120, 130, and 135 may represent specific code executed by the controller or may represent additional hardware components. The filtering and amplifying module 120 amplifies the input signal in a frequency specific manner as defined by one or more signal processing parameters specified by the controller. As described above, the patient's hearing deficit is compensated by selectively amplifying those frequencies at which the patient has a below normal hearing threshold. Other signal processing functions may also be performed in particular embodiments. The embodiment illustrated in FIG. 1, for example, also includes a gain control module 130 and a noise reduction module 135. The gain control module 130 dynamically adjusts the amplification in accordance with the amplitude of the input signal. Compression, for example, is a form of automatic gain control that decreases the gain of the filtering and amplifying circuit to prevent signal distortion at high input signal levels and improves the clarity of sound perceived by the patient. Other gain control circuits may perform other functions such as controlling gain in a frequency specific manner. The noise reduction module 135 performs functions such as suppression of ambient background noise and feedback cancellation.

The signal processing circuitry 100 may be implemented in a variety of different ways, such as with an integrated digital signal processor or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

The programmable controller specifies one or more signal processing parameters to the filtering and amplifying module and/or other signal processing modules that determine the manner in which the input signal IS is converted into the output signal OS. The one or more signal processing parameters that define a particular mode of operation are referred to herein as a signal processing parameter set. A signal processing parameter set thus defines at least one operative characteristic of the hearing aid's signal processing circuit. A particular signal processing parameter set may, for example, define the frequency response of the filtering and amplifying circuit and define the manner in which amplification is performed by the device. In a hearing aid with more sophisticated signal processing capabilities, such as for noise reduction or processing multi-channel inputs, the parameter set may also define the manner in which those functions are performed.

As noted above, a hearing aid programmed with a parameter set that provides optimal compensation may not be initially well tolerated by the patient. In order to provide for a gradual adjustment period, the controller is programmed to select a parameter set from a group of such sets in a defined sequence such that the hearing aid progressively adjusts from a sub-optimal to an optimal level of compensation delivered to the patient. In order to define the group of parameter sets, the patient is tested to determine an optimal signal processing parameter set that compensates for the patient's hearing deficit. From that information, a sub-optimal parameter set that is initially more comfortable for the patient can also determined, as can a group of such sets that gradually increase the degree of compensation. The controller of the hearing aid is then programmed to select a signal processing parameter set for use by the signal processing circuitry by sequencing through the group of signal processing parameter sets over time so that the patient's hearing is gradually compensated at increasingly optimal levels until the optimal signal processing parameter set is reached. For example, each parameter set may include one or more frequency response parameters that define the amplification gain of the signal processing circuit at a particular frequency. In one embodiment, the overall gain of the hearing aid is gradually increased with each successively selected signal processing parameter set. If the patient has a high frequency hearing deficit, the group of parameter sets may be defined so that sequencing through them results in a gradual increase in the high frequency gain of the hearing aid. Conversely, if the patient has a low frequency hearing deficit, the hearing aid may be programmed to gradually increase the low frequency gain with each successively selected parameter set. In this manner, the patient is allowed to adapt to the previously unheard sounds through the automatic operation of the hearing aid. Other features implemented by the hearing aid in delivering optimal compensation may also be automatically adjusted toward the optimal level with successively selected parameter sets such as compression parameters that define the amplification gain of the signal processing circuit at a particular input signal level, parameters defining frequency specific compression, noise reduction parameters, and parameters related to multi-channel processing.

Figure 2:
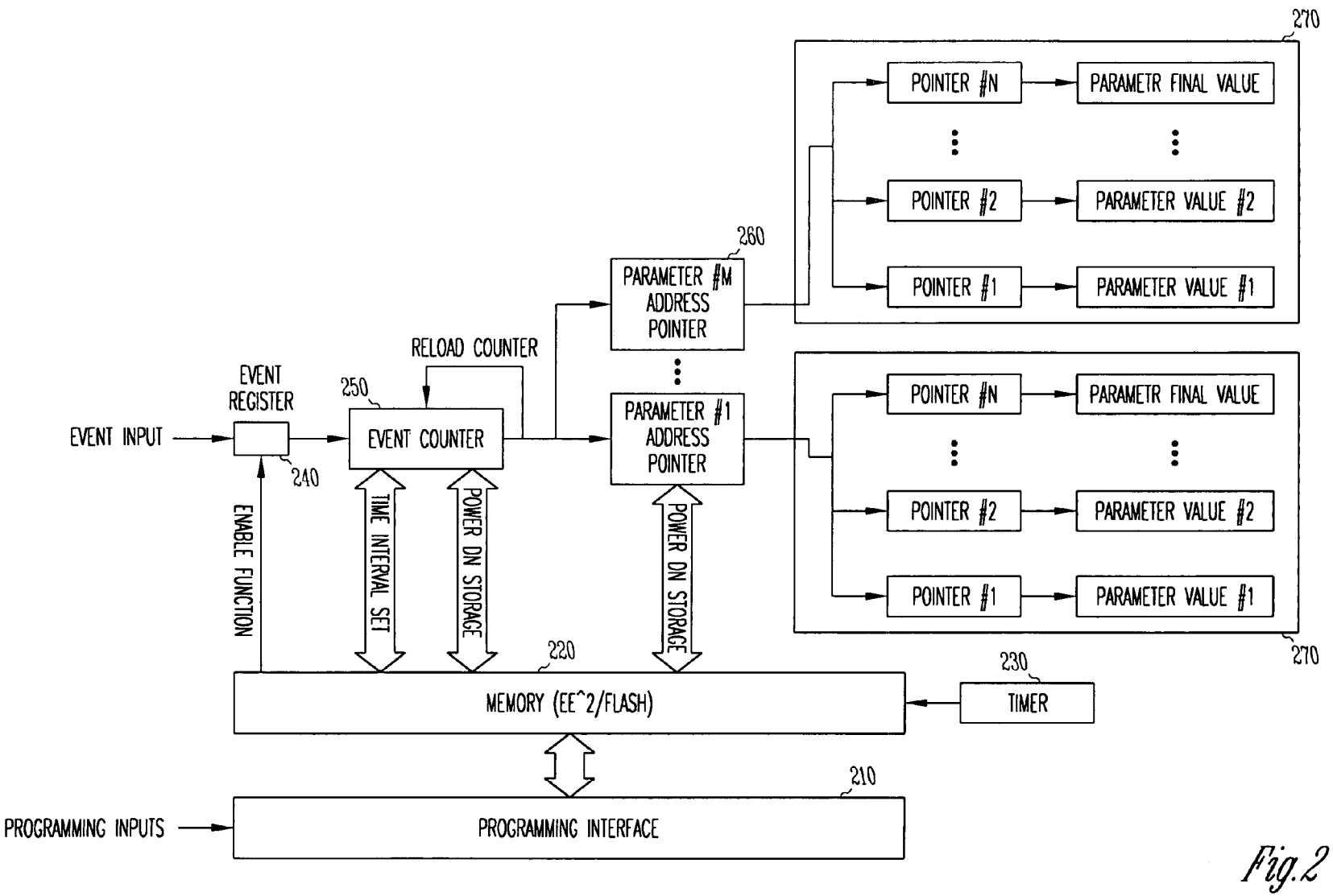
FIG. 2 illustrates a particular implementation of circuitry for automatic selection of signal processing parameters.

FIG. 2 illustrates how a scheme for altering the performance of a hearing aid over time as described above may be implemented in the programmable controller. The controller includes a flash memory 220 that retains its contents when the device is powered down. Also, other types of memory may be used such as SRAM (Static Random Access Memory) in combination with Lithium Polymer batteries. The programming interface 210 represents a communications channel by which the device may be configured with variable operating parameters that are stored in the flash memory 220. One such parameter is an enable function for an event register 240 that, when enabled, records a power event input representing the powering up of the hearing aid. The output of the event register 240 toggles an input to an event counter 250 to count the number of power up cycles. The contents of the event counter 250 is stored in the flash memory when the device is powered down and restored from the flash memory when the device is powered up so that a running tally of the number of power up cycles can be maintained. When the event counter counts a specified number of power up cycles, the counter is cleared and one or more address pointers 260 are incremented. The specified number of power up cycles counted by the event counter before it is cleared is communicated via the programming interface and stored in the flash memory. The address pointer or pointers 260 are stored in the flash memory when the device is powered down and point to a signal processing parameter set that is then used by the signal processing circuit to process received sound. The signal processing parameter sets are stored in one or more tables 270 that are contained in either the flash memory or other storage medium. In the example shown, a parameter set consists of M parameters, and a separate table is provided for each parameter. Each of the M parameter tables contains N alternative parameter values that can be included in the set. The tables thus collectively contain a group of N different parameter sets that can be selected for use by the hearing aid. The controller can then be programmed to sequence through the group of parameter sets from an initial parameter set to a final parameter set.

In an exemplary mode of operation, a user defines the N parameter sets so that each set represents a progressive increase in the degree of hearing compensation. The device is then configured to initially use parameter set #1 by specifying the address pointers 260 to point to parameter #1 in each of the parameter tables 270. Parameter set #1 may represent a sub-optimal degree of hearing compensation that the patient finds comfortable. The user also specifies a particular number of power up events before the device switches to the next parameter set. When the event counter 250 counts that number of power up events, the address pointers 260 are incremented to point to the next parameter set. This process continues until the address pointers point to parameter set # N, which may represent optimal hearing compensation for the patient.

In an alternative embodiment, a timer 230 is provided that operates when the device is powered on. The timer records the time during which the device is powered up and stores that value in the flash memory when the device is powered down. A running total of the operating time for the device can thus be maintained. Rather than basing the sequencing through the signal processing parameter sets on the number of power up events as described above, the device may successively select a new parameter set after a specified operating time interval has elapsed. The progression from each parameter set to another may occur after the same operating time interval, or different operating time intervals may be defined for each parameter set.

Although the invention has been described in conjunction with the foregoing specific embodiments, many alternatives, variations, and modifications will be apparent to those of ordinary skill in the art. Other such alternatives, variations, and modifications are intended to fall within the scope of the following appended claims.

What is claimed is:

1. A hearing aid, comprising:

an input transducer to convert sound into an input signal;

a signal processing circuit connected to the input transducer to filter and amplify the input signal in accordance with a set of specified signal processing parameters to thereby produce an output signal;

an output transducer connected to the signal processing circuit;

a programmable controller adapted to select a signal processing parameter set for operation of the signal processing circuit from a group of user-defined, predetermined parameter sets, and sequence through the group of parameter sets, wherein the group of parameter sets relate to gradually varying hearing compensation; and a power event detector and wherein the controller is programmed to sequence through the group of parameter sets in accordance with detected power events that represent powering up of the hearing aid.

2. The hearing aid of claim 1 wherein the controller is programmed to sequence through the group of parameter sets from an initial parameter set to a final parameter set.

3. The hearing aid of claim 2 wherein the final parameter set is designed to optimally compensate for a particular patient's hearing deficit.

4. The hearing aid of claim 1 further comprising a timer and wherein the controller is programmed to sequence through the group of parameter sets in accordance with elapsed operating time intervals.

5. The hearing aid of claim 4 wherein the timer is operative only when the hearing aid is powered up and further comprising a flash memory for storing operating time intervals.

6. The hearing aid of claim 5 wherein the controller is programmed to select a next parameter set from the group of parameter sets after a specified operating time interval.

7. The hearing aid of claim 1 wherein the controller is programmed to select a next parameter set from the group of parameter sets after an operating time interval specified for each parameter set.

8. The hearing aid of claim 1 further comprising a power event counter and wherein the controller is programmed to sequence through the group of parameter sets in accordance with counted power events that represent powering up of the hearing aid.

9. The hearing aid of claim 1 further comprising a power event counter and wherein the controller is programmed to sequence through the group of parameter sets in accordance with a specified number of counted power events.

10. The hearing aid of claim 1 wherein the controller is programmed to sequence through the group of parameter sets by incrementing a pointer stored in memory that indexes into one or more tables containing the group of parameter sets.

11. The hearing aid of claim 1 wherein each parameter set includes one or more frequency response parameters that define the amplification gain of the signal processing circuit at a particular frequency.

12. The hearing aid of claim 1 wherein each parameter set includes one or more gain control parameters that define how the gain of the signal processing circuit is adjusted at a particular input signal level.

13. The hearing aid of claim 1 wherein each parameter set includes one or more noise reduction parameters that define how the signal processing circuit reduces noise in the input signal.

14. A method for operating a hearing aid, comprising:

converting sound into an input signal;

filtering and amplifying the input signal in accordance with a set of specified signal processing parameters to thereby produce an output signal;

converting the output signal into sound;

specifying signal processing parameters by selecting a signal processing parameter set from a group of user-defined, predetermined parameter sets and sequencing through the group of parameter sets in accordance with a specified number of counted power events.

15. The method of claim 14 further comprising sequencing through the group of parameter sets from an initial parameter set to a final parameter set.

16. The method of claim 15 wherein the final parameter set is designed to optimally compensate for a particular patient's hearing deficit.

17. The method of claim 14 further comprising sequencing through the group of parameter sets in accordance with elapsed operating time intervals.

18. The method of claim 17 wherein the operating time intervals are recorded only when the hearing aid is powered up and further comprising storing the operating time intervals in a flash memory.

19. The method of claim 14 further comprising selecting a next parameter set from the group of parameter sets after a specified operating time interval.

20. The method of claim 14 further comprising selecting a next parameter set from the group of parameter sets after an operating time interval specified for each parameter set.

21. The method of claim 14 further comprising sequencing through the group of parameter sets in accordance with detected power events that represent powering up of the hearing aid.

22. The method of claim 14 further comprising sequencing through the group of parameter sets by incrementing a pointer stored in memory that indexes into one or more tables containing the group of parameter sets.

23. The method of claim 14 wherein each parameter set includes one or more frequency response parameters that define the amplification gain of the signal processing circuit at a particular frequency.

24. The method of claim 14 wherein each parameter set includes one or more compression parameters that define the amplification gain of the signal processing circuit at a particular input signal level.

25. A method for fitting a hearing aid to a patient, comprising:

testing the patient to determine a target signal processing parameter set that compensates for the patient's hearing deficit, where a signal processing parameter set defines at least one operative characteristic of the hearing aid's signal processing circuit; and, programming the hearing aid to select a signal processing parameter set for use by the signal processing circuitry by sequencing through a group of signal processing parameter sets over time in accordance with a specified number of counted power events so that the patient's hearing is gradually compensated at increasingly targeted levels until the target signal processing parameter set is reached.

* * * * *